United States Patent [19]

Goettl

[11] 4,391,005

[45] Jul. 5, 1983

[54] APPARATUS FOR CLEANING SWIMMING POOLS

[75] Inventor: John M. Goettl, Phoenix, Ariz.

[73] Assignee: George J. Ghiz, Phoenix, Ariz.

[21] Appl. No.: 319,686

[22] Filed: Nov. 9, 1981

[51] Int. Cl.[3] ..... E04H 3/20; B08B 3/02; B05B 15/10

[52] U.S. Cl. ..... 4/490; 134/167 R; 239/66; 239/204; 4/492; 4/496

[58] Field of Search ..... 4/490, 492, 496, 507, 4/508; 134/167 R, 168 R, 22.18; 239/382, 383, 203, 204, 205, 206, 66

[56] References Cited

U.S. PATENT DOCUMENTS

| | | | |
|---|---|---|---|
| 1,919,244 | 7/1933 | Munz | 239/204 |
| 3,408,006 | 10/1968 | Stanwood | 134/167 R |
| 3,449,772 | 6/1969 | Werner | 134/167 R X |
| 3,521,304 | 7/1970 | Ghiz | 4/490 |
| 3,675,252 | 7/1972 | Ghiz | 134/168 R X |
| 4,188,673 | 2/1980 | Canter | 4/490 X |
| 4,202,499 | 5/1980 | Mathews | 134/167 R X |
| 4,212,088 | 7/1980 | Goettl et al. | 4/490 |
| 4,271,541 | 6/1981 | Mathews | 4/490 |
| 4,300,246 | 11/1981 | Gould | 4/490 |
| 4,322,860 | 4/1982 | Gould | 4/490 |

*Primary Examiner*—Henry K. Artis
*Attorney, Agent, or Firm*—Cahill, Sutton & Thomas

[57] ABSTRACT

Apparatus for intermittently directing one or more streams of water across the inner surface of a swimming pool structure for cleaning the surface. A cylindrical retractable nozzle head actuated by fluid pressure moves to an active, extended position to expose nozzle passages therein when water under pressure is applied thereto. The nozzle passages are formed in diametrically and symmetrically disposed thickened wall regions of the nozzle head to provide a nozzle head that is balanced about its longitudinal axis. In certain embodiments of the invention, a pair of nozzle passages are formed in the thickened regions and some or all of the passages have destructible membranes blocking communication with the interior of the nozzle head, which membranes may be selectively drilled out at the time of installation of the apparatus. The nozzle head, which is preferably molded from plastic material, may contain a weight member for additional balance and to assist in retraction of the head to its inactive position.

6 Claims, 4 Drawing Figures

FIG. 1
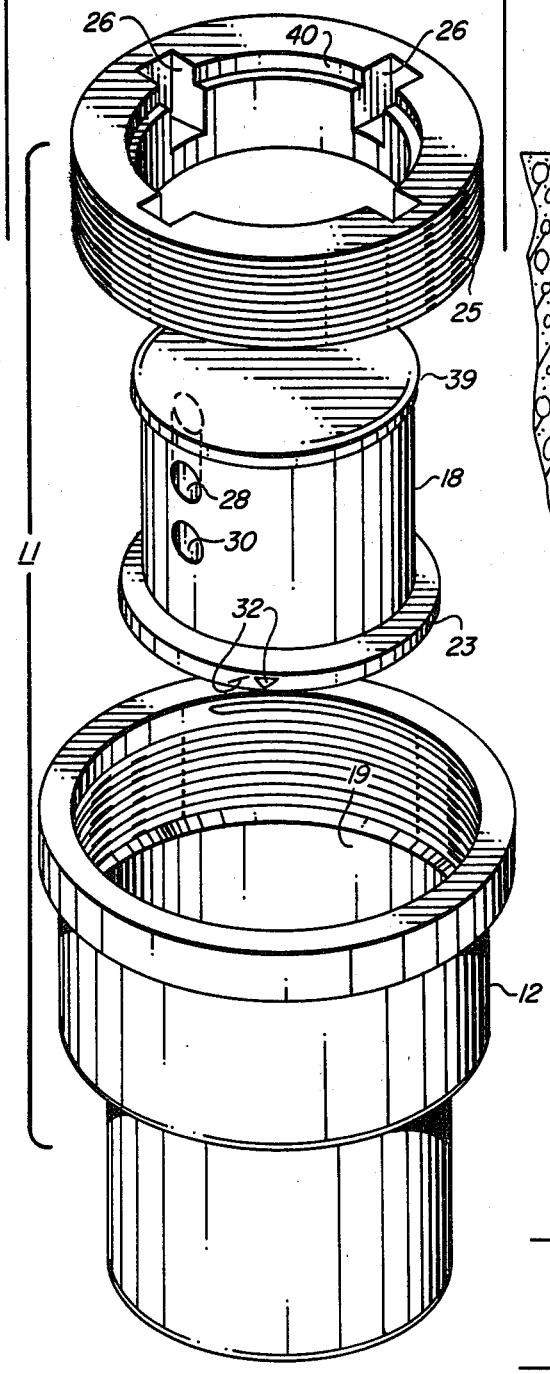
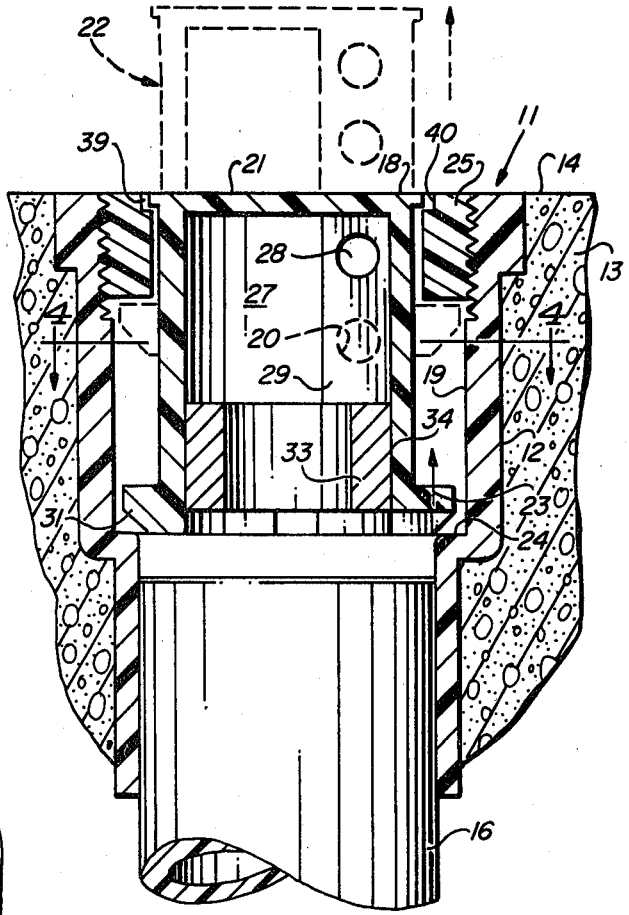
FIG. 2
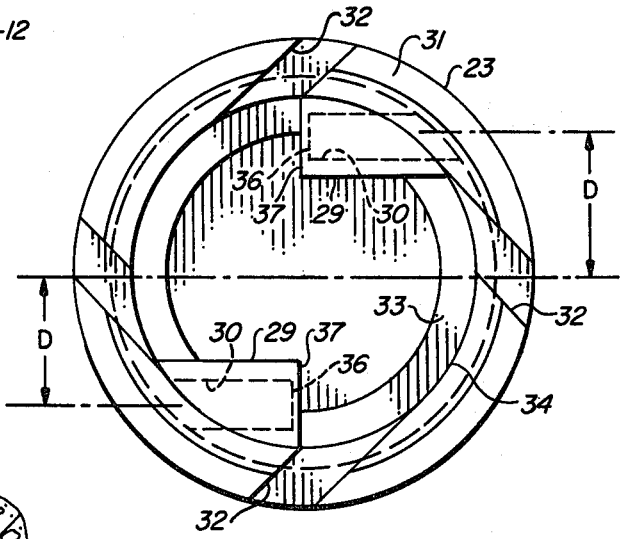
FIG. 3
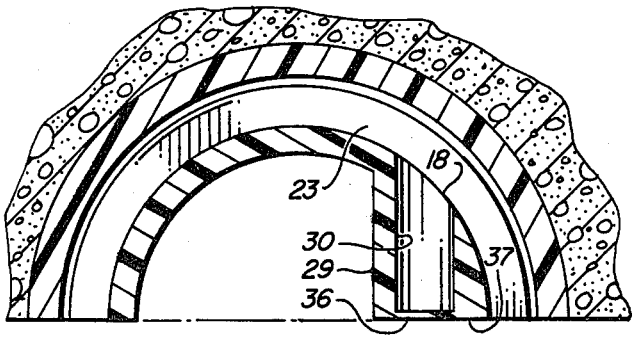
FIG. 4

APPARATUS FOR CLEANING SWIMMING POOLS

BACKGROUND OF THE INVENTION

This invention relates to apparatus for cleaning swimming pools, and more particularly, to water delivery assemblies mounted at the inner surface of the pool for directing streams of water across the surface to loosen deleterious material from the surface and place it in suspension so it can be carried through the pool outlets to the cleaning filter.

The invention further relates to that class of pool cleaning apparatus in which the water delivery assemblies include rotatably and retractably mounted nozzle heads housed in a pool wall. When supplied with water under pressure, each nozzle head moves to an extended, active, position exposing nozzle passageways which eject jets of water across the surface of the pool. This is sometimes referred to as a "pop-up nozzle". The construction of the nozzle head is such that the reaction from the jet stream causes partial rotation of the head as it moves from its retracted to its extended position. Such rotation is random so that with each activation of the nozzle, a different arcuate region of the pool surface surrounding the nozzle is swept by the jet of water. Eventually, through successive operations, the entire area surrounding the nozzle is swept.

U.S. Pat. No. 3,521,304 entitled "Swimming Pool Cleaning System" granted July 21, 1970 to G. J. Ghiz and U.S. Pat. No. 3,675,252, entitled "Pop-up Head for Water Jet Pool Cleaning System" granted July 11, 1972 to G. J. Ghiz, disclose pool cleaning systems employing rotating nozzles for directing water jets across the interior surface of the pool structure for cleaning the surface. A pool cleaning system employing intermittently actuated pop-up type nozzles is disclosed in U.S. Pat. No. 4,212,088 entitled "Apparatus for Cleaning Swimming Pools" granted July 15, 1980 to J. M. Goettl and G. J. Ghiz. A similar system with a somewhat different pop-up nozzle is disclosed in U.S. Pat. No. 4,188,673 entitled "Rotatable Pop-Up Water Delivery Head for Pool Cleaning Systems," granted Feb. 19, 1980 to H. L. Carter.

SUMMARY OF THE INVENTION

Among the principal objects of this invention are improvements to the reliability and operating efficiency of pop-up type water delivery assemblies for pool cleaning systems.

Pop-up nozzle apparatus such as those described in U.S. Pat. No. 4,212,088 and U.S. Pat. No. 4,188,673 mentioned above, customarily employ a pop-up nozzle head in which a nozzle passage is disposed eccentrically of the rotational axis of the head and which discharges water in a non-radial direction from the head causing the head to rotate as it moves out of its housing to its active position. Because of the eccentricity of the nozzle passage, the head is asymmetrical and therefore unbalanced about its rotational axis. This is disadvantageous when the nozzle apparatus is installed in a sloping portion of the pool wall with the axis of the nozzle head disposed other than in a vertical position. In this attitude there is a tendency for the heavier region of the nozzle head to gravitate to the low side of the delivery assembly, i.e., downhill with reference to the pool wall, each time the water pressure to the nozzle apparatus is cut off. The operating consequence of this is that each time the assembly is activated, the nozzle tends to start its rotation from the same position and then rotates to substantially the same active position. The result is that the jet of cleaning water sweeps the same general arcuate area of the surrounding pool surface each time the assembly is activated instead of moving to different arcuate regions. This rotational failure is aggravated in lightweight nozzle heads made from molded plastic materials. This is the preferred construction for such heads because the plastic material is low in cost and, being non-corrosive, requires little maintenance.

The improved nozzle head constructed in accordance with this invention has diametrically opposed generally symmetrical thickened wall regions in its interior. These thickened wall regions have formed therein symmetrically disposed nozzle passages arranged to convey water out of the nozzle head in non-radial directions. The nozzle passages are designed to issue jets of water in opposite directions from the nozzle with each jet being eccentrically disposed with respect to the center line of the nozzle head so that both jets react to rotate the nozzle head. So long as the nozzle passages are nearly the same size, the nozzle head is balanced about its axis of rotation so that there is no tendency for the head to return to any particular position even though the nozzle assembly is installed with the axis of the nozzle head off of vertical. Moreover, with two nozzle passages to convey the cleansing jet stream, it is possible for the required amount of water to be carried by two smaller passages rather than a single large passage as was done in the prior art, thereby permitting the center line of these passages to be placed a greater distance from the axis of the head in a position to impart their turning force through greater moment arms. The resulting greater turning force applied to the nozzle head acts to overcome any tendency for the nozzle head to become stuck against rotation.

Further in accordance with this invention, it is contemplated that a second pair of nozzle passages be disposed in the nozzle head either above or below the pair of nozzle passages mentioned above. By using four nozzle passages instead of two, it is possible to further reduce the size of each passage and again position the passages a greater distance from the center line of the nozzle head.

A further feature of the improved nozzle of this invention is the incorporation of weight means uniformly about the axis of rotation of the nozzle head for the purpose of increasing the weight of the head. This weight means assists in retracting the nozzle head when the pressurized water is no longer supplied thereto and eliminates the need to provide any spring means for ensuring retraction of the nozzle head. The added weight also renders inconsequential any slight intentional or unintentional differences in the configuration of the nozzle passages in the nozzle head. If, for example, one nozzle passage is slightly larger than its opposite passage, that difference will have very little effect so far as unbalancing the heavier nozzle head equipped with the weight means.

It is a further object of this invention to enhance the adaptability of pop-up type pool cleaning water delivery assemblies. It has been recognized for some time that pool cleaning assemblies in certain applications are required to emit greater or lesser flow of cleaning water than similar units in other applications. For example, nozzles installed in shallow portions of a pool, such as on a step landing, usually should emit a relatively low flow rate of cleaning water so as not to unnecessarily disturb the surface of the pool or cause water to be thrown from the pool. Cleaning delivery assemblies disposed in deeper regions of the pool and in larger pools are required to emit considerably larger quantities of cleaning water. Adaptability is provided in the nozzle head of this invention by initially molding the nozzle head with one or more of the nozzle passages therein closed off from communication with the interior of the nozzle head by destructable membranes. The membrane or membranes are intentionally molded in place when the nozzle head is formed. This gives the installer of the pool cleaning system the option of drilling out or otherwise destroying the membrane or membranes in a selected number of the nozzle passages so that the nozzle emits the required flow of cleaning water needed for the particular pool and the particular location of the delivery assembly.

BRIEF DESCRIPTION OF THE DRAWING

FIG. 1 is an exploded isometric view of the principal components of the pool cleaning water delivery assembly of this invention.

FIG. 2 is a vertical sectional view through the assembly with the solid line rendition illustrating the inactive, or retracted, position of the nozzle head. The dotted line rendition illustrates the active, or cleaning, position of the nozzle head.

FIG. 3 is a view from beneath illustrating the bottom of the movable nozzle head.

FIG. 4 is a partial sectional view of the assembly taken generally as indicated by the line 4—4 in FIG. 2.

DESCRIPTION OF THE PREFERRED EMBODIMENTS

As is best shown in FIGS. 1 and 2, the water delivery assembly of this invention, indicated generally by the numeral 11, comprises three principal components. There is provided a housing 12 which is adapted to be embedded in the wall structure of a pool, illustrated fragmentally at 13, having an interior surface 14 which requires cleaning. The housing 12 is positioned in an appropriate location within the pool structure 13 at the time of construction of the pool and is located in such a manner that its open upper end is flush with the pool surface 14 and in open communication with the interior of the pool. The lower end of housing 12 is in open communication with a conduit 16 connecting the housing 12 with a source of pressurized cleaning water (not shown). The system for intermittently supplying the water delivery assembly 11 with pressurized cleaning water preferably is like that illustrated in U.S. Pat. No. 4,212,088 mentioned above.

Direction of cleaning water out of the housing 12 and to the interior of the pool 13 is effected by a nozzle head 18 disposed within a generally cylindrical chamber 19 in the housing 12.

The nozzle head 18 is itself generally cylindrical in configuration and is positioned for rotational movement about its vertical axis and for reciprocal movement along that axis from an inactive or retracted, position illustrated by the solid lines in FIG. 2 to an active or cleaning, position illustrated by the dotted lines in FIG. 2. Stated differently, the nozzle head is movable from a retracted solid line position of FIG. 2, in which its closed upper surface 21 is generally flush with the top end of housing 12 and the pool interior surface 14, to a popped-up position (dotted line in FIG. 2) in which a substantial portion 22 of the upper region of the nozzle head projects into the interior of the pool. Control of the two extreme positions of the nozzle head 18 is determined by a stop collar 23 integral with the nozzle head at its lower end. The collar 23 abuts an annular stop ledge 24 formed in the housing 12 to set the retracted or inactive position of the nozzle head. Movement of the nozzle head 18 to its active, or popped up, position is limited by collar 23 engaging a retainer ring 25 threadably received in the upper end of housing 12. Retainer ring 25 is preferably provided with a plurality of key slots 26 to receive a tool to facilitate insertion or removal of the retainer ring from the housing 12. It is to be noted that the construction of the housing 12 and the retaining ring 25 is such that upon removal of the ring from the housing, the nozzle head 18 can easily be removed through the open end of the housing for cleaning, repair or replacement.

Nozzle head 18 has an open lower end and a hollow interior 27 to permit cleaning water to flow therethrough and into upper and lower pairs of nozzle passages, 28 and 30, respectively, formed in thickened wall regions 29 of the nozzle head. These thickened wall regions 29 and nozzle passages 28 and 30 occupy that portion of the nozzle 18 which projects into the interior of the pool when the nozzle assumes its active, cleaning, position with respect to the housing 12.

The manner in which the thickened wall regions 29 are formed and the manner in which the nozzle passages 28 and 30 are provided therein is deemed to be particularly important in carrying out the principles and objectives of this invention. It will be noted, particularly from FIG. 3, that the thickened wall regions 29 are mirror images of each other, and that they are diametrically and symmetrically disposed interiorly of the nozzle head 18. Similarly, the nozzle passages 28 and 30 at one side of the nozzle are symmetrically and diametrically disposed with respect to the nozzle passage on the other side of the nozzle head. It should be noted that althrough the drawings illustrate nozzle head 18 as possessing two pairs of nozzle passages 28 and 30, one pair being disposed immediately above the other pair, and this is a preferred embodiment of the invention, certain benefits of the invention can be derived by employing but a single pair of nozzle passages 28 diametrically and symmetrically disposed within the nozzle head.

The significance of the symmetry of the thickened regions 29 and nozzle passages 28 and 30 is that this ensures that the nozzle head 18 is balanced about its longitudinal axis of rotation and this feature contributes to the reliability and improved operating characteristics of the water delivery assembly as is explained in greater detail hereinafter.

The axes of opposite nozzle passages of both pairs 28 and 30 are displaced from the axis of rotation of the nozzle head 18 as indicated by the dimension D in FIG. 3. Preferably, the two nozzle passages on one side of the nozzle head lie in a plane that is displaced an equal distance from a plane passing through the axis of the nozzle head and parallel to a plane containing the axes of the opposite two passages.

The purpose of the eccentric disposition of nozzle passages 28 and 30 is to cause the stream of cleaning water issuing therefrom to impart a turning moment to the nozzle head 18. This reaction force causes nozzle head 18 to rotate during initial activation of the assembly as the nozzle stop collar 23 lifts free of the stop ledge 24 and until the stop collar 23 engages retainer ring 25. Frictional engagement between stop collar 23 and retainer ring 25 stops further rotation of nozzle head 18. The nozzle head remains stationary during the remainder of the cleaning cycle for that particular delivery assembly. The degree of rotation of the nozzle head 18 during activation is random, depending upon such factors as the pressure of the cleaning water supplied thereto, the rate of buildup of that water pressure as the control valve is opened to supply the cleaning water, and the design of the nozzle exit passages 28 and 30.

In accordance with this invention, the nozzle head 18 is equipped with more than one eccentrically disposed nozzle passage 28 and 30. In nozzle heads of the prior art, the single nozzle passage provided therein was required to be of sufficient cross-sectional area to carry the required flow of cleaning water with a reasonable pressure drop. This passage frequently occupied a large volume of the nozzle head with the consequence that the center line of the passage was only slightly displaced from the axis of rotation of the nozzle head. By employing multiple nozzle passages 28 and 30 in the nozzle head 18 of this invention, it is possible to achieve the desired flow of cleaning water with smaller diameter passages which can be located a greater distance "D" (see FIG. 3) from the axis of rotation of the nozzle head. A greater distance D means a greater moment arm through which the jet reaction forces act to rotate the nozzle head. The greater forces, of course, overcome any tendency for the nozzle head 18 to stick, or jam, in the housing 12. The operating reliability of the delivery assembly is thus improved.

In order for the delivery assembly 11 to perform its intended function, the nozzle head 18 should come to rest in its extended, cleaning, position in a different radial position each time it is activated so as to ensure that the jet of cleaning water issuing therefrom sweeps a different arcuate region of the pool surface surrounding the assembly each time the unit is activated. To ensure successful operation, the nozzle head 18 must enjoy complete freedom of movement during activation in both an axial direction and a circular direction. It will be noted that the periphery of stop collar 23 is spaced from the wall of housing chamber 19 and the upper body of the nozzle head 18 is of slightly smaller diameter than the interior of retainer ring 25. This construction permits water to flow completely around and bypass the nozzle head 18 as it is moving toward its active position so there is formed a water bearing between the nozzle head 18, the housing chamber 19, and retainer ring 25. The water bearing supports the nozzle head 18 for axial and rotational movement. This bypass or bearing flow of water, of course, ceases when the stop collar 23 seats against retainer ring 25 and the nozzle head ceases to move either axially or rotationally.

To reduce the surface contact area between stop collar 23 and the housing stop ledge 24 and to reduce the likelihood of these members becoming stuck together, the stop collar 23 is preferably chamfered on its outer lower face as indicated at 31. It is also preferred that the lower face of the stop collar portion 23 of nozzle head 18 have slot-like passageways 32 cut therein in such a manner that the passageways are eccentric with respect to the axis of rotation of the nozzle head 18. These passageways 32 serve a dual function. In the first instance, they allow a low level of cleaning water flow to pass around the nozzle head 18 without lifting the nozzle head. Such a condition might be caused by a leaky shut-off valve in the cleaning water supply system for the delivery assembly. It is highly desirable that when not in use, the nozzle head 18 be in a fully retracted position with its upper surface 21 flush with the pool surface 14 so as not to interfere with normal use of the pool. Secondly, because of the eccentric disposition of the passageways 32, during the initial surge of cleaning water being supplied to the delivery assembly 11 and as the nozzle head 18 begins to lift from the step ledge 24, there is a rotational force imparted to the nozzle head 18 by the cleaning water flowing through the passageways 32. The disposition of the passageways 32 is such as to impart a rotational force to the nozzle 18 that is in the same direction as the rotational forces imparted by cleaning water exiting the nozzle passages 28 and 30.

A further feature contributing to the operating reliability of the delivery assembly of this invention is the incorporation of weight means 33 into the body of nozzle head 18. As best shown in FIGS. 2 and 3, the weight means 33 preferably takes the form of a cylindrical section of brass pipe that is pressed into the lower, open region of nozzle head 18. If desired, the peripheral surface 34 of the weight means 33 can be knurled or otherwise roughened to cause the weight means to be firmly held in place within the nozzle head 18.

Although it is suggested that the weight means 33 be made of brass, it can be made from any other heavy, noncorrosive material. It is important that it be of greater density than the material from which the nozzle head 18 is formed. Ordinarily, the nozzle head preferably be molded from acrylonitrude-butadiene-styrene (ABS) or similar plastic material and is of relatively light weight. The weight means 33 being heavier, contributes functionally to the operation of the delivery assembly in two respects. The weight means 33 causes the nozzle head 18 to retract to its lower position when the flow of cleaning water is shut off. Also, the weight means 33 adds to the overall weight of the nozzle head 18 so that any slight differences in the configuration of the thickened wall regions 29 of the nozzle head or of the nozzle passages 28 and 30 will have little effect on the balance or symmetry of the nozzle head. It should also be noted that the weight means 33 need not necessarily be of cylindrical configuration. The weight means could very well take the form of several different discrete weight members disposed symmetrically about the axis of rotation of the nozzle head 18. The important condition is symmetry to contribute to the balance of the nozzle head 18.

As mentioned previously, one of the most significant features of the delivery assembly of this invention is the symmetrical, and hence balanced, condition of the nozzle head 18 in a rotational sense. It should be obvious, of course, that a rotationally balanced nozzle head will rotate more truly about its central axis during movement from its inactive to its active position and hence there will be less of a tendency for the nozzle head 18 to cant and become wedged or jammed in the housing 12. Less obvious, however, if the tendency for the asymmetric, unbalanced, nozzle heads of the prior art to tend to drift in rotation to a particular position when the delivery assembly is inactivated if the assembly is installed with the axis of the nozzle head at some angle other than vertical. This often is the case when the cleaning delivery assembly is installed in the sloping region of the bottom of a pool. The unbalanced nozzle head in such an installation will, upon having the water supply thereto shut off, tend to have its heavier side turn to the lower side of the delivery assembly as the nozzle head descends into its housing. Unfortunately, this means that when the nozzle is activated, it starts its rotation from the same angular starting point and stops its angular rotation in its active position in essentially the same area each time. Thus, only a limited arcuate area of pool surface surrounding the delivery means is ever swept by jets of cleaning water and the delivery assembly is not performing its intended function. All of these difficulties are, of course, overcome by the improved symmetrical and balanced design of this invention. The rotational performance of the nozzle head 18 of this invention is not affected by the assembly being installed in a non-vertical position.

Another and equally important feature available with the improved design of nozzle 18 of this invention is that of adaptability of the delivery assembly to various pool requirements. In accordance with the invention, at least some, and possibly all, of the nozzle passages 28 and 30 are blocked off from communication with the interior of the nozzle head 18 by thin, destructible membrane elements 36 which are molded in place as a part of the thickened wall regions 29 of the nozzle head. These blocking membranes 36 can easily by provided during molding of the nozzle head 18 by simply arranging for the retractable nozzle passage cores to end short of contact with the plug core providing the interior 27 of the nozzle head 18. To open up communication between the interior of the nozzle head and any one nozzle passage, it is only necessary to drill or otherwise destroy the membrane by means of a tool inserted through the open end of the nozzle passage 28 or 30.

Providing a nozzle head 18 equipped with a plurality of nozzle passages 28 and 30 some or all of which are blocked by the destructible membranes 36 affords the installer the opportunity to customize, so to speak, the nozzle to the requirements of the pool and the location of the water delivery assembly at the time of installation. It can be appreciated that the cleaning water delivery assemblies for small, residential pools or for location on step landings of pools need not and should not deliver as great a quantity of cleaning water as say a delivery assembly located on the bottom of a large commercial pool. With the nozzle of this invention, the installer simply drills out and renders useable such of the nozzle passages 28 and 30 as are required to provide the cleaning water flow needed for that particular location. Further adaptability can be provided for the delivery assembly by making some of the nozzle passages 28 of a different size (diameter) than other passages (see FIG. 2).

It will be noted from FIGS. 3 and 4 that the preferred configuration for the thickened wall regions 29 of the nozzle head 18 provides flat, upright radially disposed flat surfaces 37 lying in a common plane within the interior of the nozzle head. These surfaces are at right angles to the axes of the nozzle passages 28 and 30 and, hence, ideally suited to provide the thin membrane elements 36 for initially closing off communication to certain of the nozzle passages. The membrane elements 36 thus formed are easily accessible and destructible by access through the nozzle passages. It is understood, however, that the thickened wall regions 29 may have configurations other than that shown herein but configured preferably to provide the destructible membrane elements 36 at the ends of the passageways in such a manner that they can be opened up without the necessity for drilling additional openings or passages from the interior of the nozzle head.

A final feature of the water delivery assembly of this invention calls for the provision at the uppermost portion of the cylindrical side wall of the nozzle head 18 of a circumferential holding ring 39. The diameter of holding ring 39 is just slightly greater than the opening through retainer ring 25 so that the retainer ring 25 may with relative ease, be forced down over the top of nozzle head 18 and past the holding ring. Once this is accomplished, the holding ring 39 acts as releasable connecting means and prevents accidental separation of the nozzle head 18 and retainer ring 25. Thus, the nozzle head 18 can be lifted from the housing 12 together with retainer ring 25 by a suitable tool engaging key slots 26 in the retainer ring. It is not necessary to separately fish for the nozzle head to effect its removal. The retainer ring 25 is preferably provided with a relief groove 40 in its upper face to prevent interference or binding of holding ring 39 against the retainer ring when the unit is assembled and the nozzle head 18 is in its inactive, retracted position.

What is claimed is:

1. In an intermittently activated water delivery assembly for cleaning a swimming pool, comprising:

a generally cylindrical housing in communication with a source of water under pressure, said housing being in open communication with the interior of said pool at a surface of the pool structure, and a generally cylindrical hollow nozzle head rotatably mounted in said housing and being axially movable from an inactive, retracted position therein to an active position in which a portion of said head projects outside said housing within said pool when water under pressure is supplied to said housing;

the improvement comprising:

thickened wall regions diametrically and symmetrically disposed interiorly of the portion of said nozzle head projecting outside said housing, each of said wall regions having at least one nozzle passage formed therein, said nozzle passages being symmetrically disposed in said nozzle head and being constructed to deliver streams of water non-radially from said nozzle head across said surface of the pool structure for cleaning said surface.

2. The water delivery assembly of claim 1 wherein each of said thickened wall regions has two nozzle passages formed therein and the passages in one region having their axes in a plane disposed equidistant from the axis of said nozzle head and parallel to a plane containing the axes of the passages in said other thickened region.

3. The water delivery assembly of claim 1 or claim 2 wherein at least one of said nozzle passages has a destructible membrane blocking communication between said passage and the interior of said nozzle head.

4. The water delivery assembly of claim 1 or claim 2 including weight means disposed uniformly about the axis of said nozzle head for increasing the weight of said nozzle head, said weight means having a greater density than the material from which the major portion of said nozzle head is made.

5. The water delivery assembly of claim 1 or claim 2 wherein a retainer ring threadably received in said housing determines the active position of said nozzle head and means are provided releasably connecting said nozzle head and said retainer ring for joint removal from said housing.

6. In an intermittently activated water delivery assembly for cleaning a swimming pool, comprising:

a generally cylindrical housing in communication with a source of water under pressure, said housing being in open communication with the interior of said pool at a surface of the pool structure, and a generally cylindrical hollow nozzle head rotatably mounted in said housing and being axially movable from an inactive, retracted position therein to an active position in which a portion of said head projects outside said housing within said pool when water under pressure is supplied to said housing;

the improvement comprising:

a retainer ring threadably received in said housing for determining the active position of said housing, and means are provided for releasable connecting said nozzle head and said retainer ring for joint removal from said housing, said last named means comprising a stop collar carried by said nozzle head and engageable with said retainer ring for limiting movement of said nozzle head to its active position and a holding ring formed on said nozzle head, said holding ring having a diameter slightly greater than the inside diameter of said retainer ring whereby said retainer ring may be forced over said holding ring to assemble said retainer ring and said nozzle head but interference between the holding ring and said retainer ring prevents accidental separation of the nozzle head and the retainer ring when the retainer ring is removed from the housing.

* * * * *